US009752466B2

(12) United States Patent
Son et al.

(10) Patent No.: US 9,752,466 B2
(45) Date of Patent: Sep. 5, 2017

(54) CONTINUOUS VARIABLE VALVE DURATION APPARATUS AND ENGINE PROVIDED WITH THE SAME

(71) Applicant: Hyundai Motor Company, Seoul (KR)

(72) Inventors: You Sang Son, Whasung-Si (KR); Kyoung Pyo Ha, Whasung-Si (KR); Back Sik Kim, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 52 days.

(21) Appl. No.: 14/923,255

(22) Filed: Oct. 26, 2015

(65) Prior Publication Data

US 2016/0160697 A1 Jun. 9, 2016

(30) Foreign Application Priority Data

Dec. 9, 2014 (KR) ..... 10-2014-0175836

(51) Int. Cl.

| | |
|---|---|
| ***F01L 1/34*** | (2006.01) |
| ***F01L 1/344*** | (2006.01) |
| ***F01L 1/047*** | (2006.01) |
| ***F01L 1/053*** | (2006.01) |
| ***F01L 1/356*** | (2006.01) |
| ***F01L 13/00*** | (2006.01) |

(52) U.S. Cl.

CPC ..... *F01L 1/34413* (2013.01); *F01L 1/047* (2013.01); *F01L 1/053* (2013.01); *F01L 1/356* (2013.01); *F01L 13/0015* (2013.01); *F01L 2001/0473* (2013.01); *F01L 2001/0476* (2013.01); *F01L 2001/054* (2013.01); *F01L 2013/0078* (2013.01); *F01L 2820/032* (2013.01)

(58) Field of Classification Search

CPC ..... F01L 1/34413; F01L 1/047; F01L 2001/0476; F01L 2001/0473; F01L 2001/054; F01L 1/356; F01L 13/0015; F01L 2013/0078; F01L 2820/032

USPC ..... 123/90.15, 90.16, 90.17

See application file for complete search history.

(56) References Cited

U.S. PATENT DOCUMENTS

| | | | | |
|---|---|---|---|---|
| 5,924,334 | A | 7/1999 | Hara et al. | |
| 7,721,691 | B2 | 5/2010 | Tateno | |
| 2009/0000582 | A1* | 1/2009 | Tanabe | F01L 1/022 123/90.17 |
| 2010/0059005 | A1 | 3/2010 | Stone et al. | |

FOREIGN PATENT DOCUMENTS

| | | | |
|---|---|---|---|
| JP | 2009-236010 | A | 10/2009 |
| KR | 10-2013-0063819 | A | 6/2013 |
| KR | 10-1326818 | B1 | 11/2013 |

* cited by examiner

*Primary Examiner* — Zelalem Eshete

(74) *Attorney, Agent, or Firm* — Morgan, Lewis & Bockius LLP

(57) ABSTRACT

A continuous variable valve duration apparatus includes a camshaft, a plurality of wheels mounted to the camshaft, of which a wheel key is formed thereto respectively, a plurality of cam portions of which a cam and a cam key are formed thereto respectively, of which the camshaft is inserted thereto, of which relative phase angle with respect to the camshaft is variable, a plurality of inner brackets connected with the each wheel key and the each cam key, a slider housing of which the each inner bracket is rotatably inserted thereto, and rotatably configured around a hinge bracket connected to a cylinder head and a control portion selectively moving the slider housings to change relative position of a rotation center of the inner brackets.

19 Claims, 8 Drawing Sheets

CONTINUOUS VARIABLE VALVE DURATION APPARATUS AND ENGINE PROVIDED WITH THE SAME

CROSS-REFERENCE TO RELATED APPLICATION

The present application claims priority to and the benefit of Korean Patent Application No. 10-2014-0175836 filed on Dec. 9, 2014, the entire contents of which is incorporated herein for all purposes by this reference.

BACKGROUND OF THE INVENTION

Field of the Invention

The present invention relates to a continuous variable valve duration apparatus and an engine provided with the same. More particularly, the present invention relates to a continuous variable valve duration apparatus an engine provided with the same which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directly providing a continuous variable valve duration apparatus and an engine provided with the same which may vary opening duration of a valve according to operation conditions of an engine, with a simple construction.

According to various aspects of the present invention, a continuous variable valve duration apparatus may include a camshaft, a plurality of wheels mounted to the camshaft, of which a wheel key is formed thereto respectively, a plurality of cam portions of which a cam and a cam key are formed thereto respectively, of which the camshaft is inserted thereto, of which relative phase angle with respect to the camshaft is variable, a plurality of inner brackets connected with the each wheel key and the each cam key, a plurality of a slider housings of which the each inner bracket is rotatably inserted thereto, and rotatably configured around a hinge bracket connected to a cylinder head and a control portion selectively moving the slider housings so as to change relative position of a rotation center of the inner brackets.

The continuous variable valve duration apparatus may further include first pins of which a wheel key slot, the each wheel key is slidably inserted thereto, is formed thereto respectively and second pins of which a cam key slot, the each cam key is slidably inserted thereto, is formed thereto respectively, and wherein a first sliding pin hole and a second sliding pin hole, of which the first pin and the second pin are inserted thereto respectively, may be formed to the inner bracket.

The first pin and the second pin may be formed as a circular cylinder shape and the first sliding pin hole and the second sliding pin hole may be formed for the first pin and the second pin to be rotated within thereto.

The wheel key slot of the first pin and the cam key slot of the second pin may be formed opposite direction.

Parts of the first sliding pin hole and the second sliding pin hole may be opened for movements of the wheel key and the cam key not to be interrupted.

The continuous variable valve duration apparatus may further include a bearing inserted between the slider housing and the inner bracket.

The slider housings may be connected by a slider housing connecting plate.

The control portion may include a control shaft, and wherein a shaft hole may be formed to the housing connecting plate for the control shaft to be inserted thereto, and a rotation center of the inner brackets may be changed with respect to a rotation center of the camshaft according to a movement of the control shaft.

The control portion may further include a control gear connected with the control shaft and a control motor engaged with the control gear and selectively rotating the control gear.

A hinge connecting portion hingedly connected with the hinge bracket may be formed to the slider housing connecting plate.

The wheel may be connected with the camshaft through a connecting pin.

According to various aspects of the present invention, an engine may include a camshaft, a plurality of wheels mounted to the camshaft, of which a wheel key is formed thereto respectively, and disposed corresponding to each cylinder, a plurality of cam portions of which a cam and a cam key are formed thereto respectively, of which the camshaft is inserted thereto, of which relative phase angle with respect to the camshaft is variable and disposed corresponding to the each cylinder, a plurality of inner brackets of which a first sliding pin hole and a second sliding pin hole, connected with the each wheel key and the each cam key; are formed respectively thereto, a plurality of a slider housings of which the each inner bracket is rotatably inserted thereto, and rotatably configured around a hinge bracket connected to a cylinder head, first pins of which a wheel key slot, the each wheel key is slidably inserted thereto, is formed thereto respectively and rotatably inserted into the first sliding pin hole, second pins of which a cam key slot, the each the cam key is slidably inserted thereto, is formed thereto opposite to the wheel key slot respectively, and rotatably inserted into the second sliding pin hole and a control portion selectively moving the slider housings so as to change relative position of a rotation center of the inner brackets.

Parts of the first sliding pin hole and the second sliding pin hole may be opened for movements of the wheel key and the cam key not to be interrupted.

The engine may further include a bearing inserted between the slider housing and the inner bracket.

The slider housings may be connected by a slider housing connecting plate.

The control portion may include a control shaft, and wherein a shaft hole may be formed to the housing connecting plate for the control shaft to be inserted thereto, and a rotation center of the inner brackets may be is changed with respect to a rotation center of the camshaft according to a movement of the control shaft.

The control portion may further include a control gear connected with the control shaft and a control motor engaged with the control gear and selectively rotating the control gear.

A hinge connecting portion hingedly connected with the hinge bracket may be formed to the slider housing connecting plate.

The wheel may be connected with the camshaft through a connecting pin.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
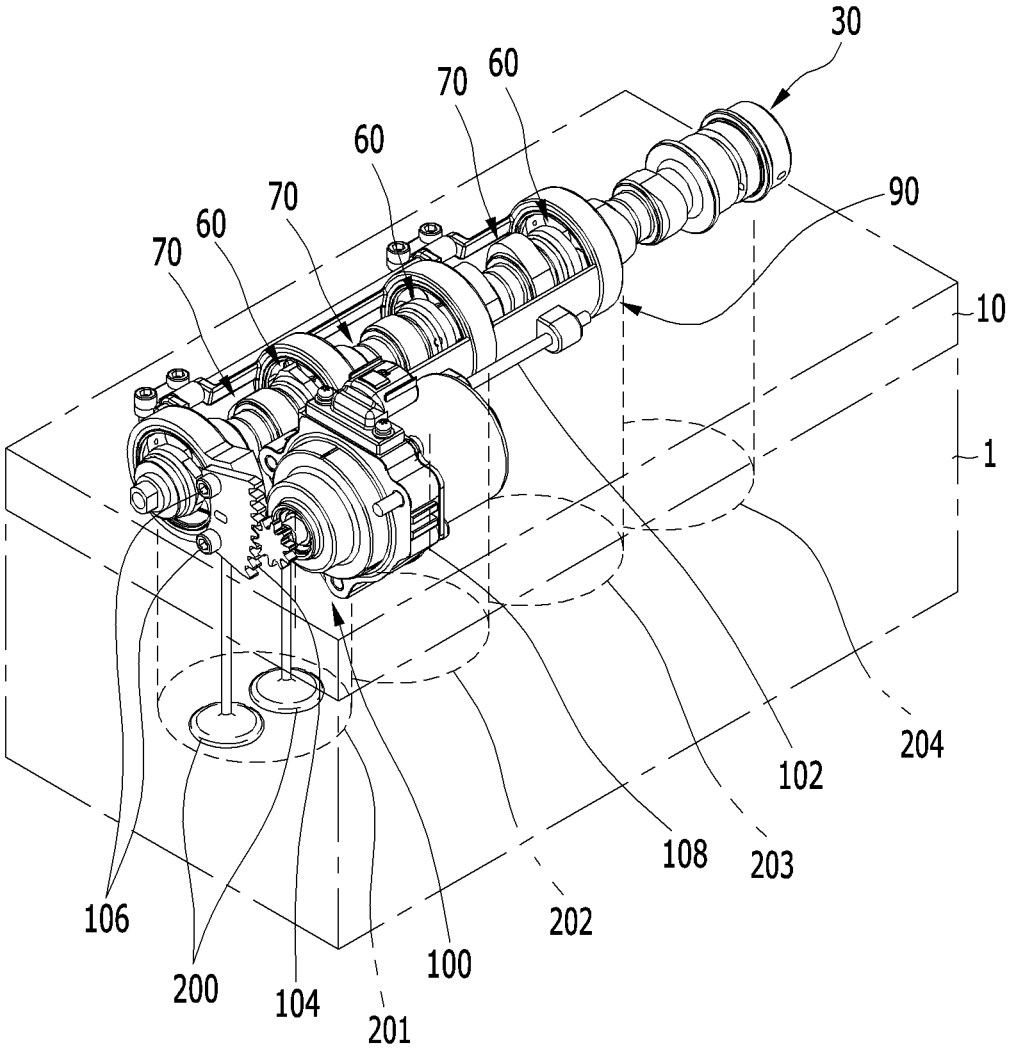
FIG. 1 is a perspective view of an engine provided with a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
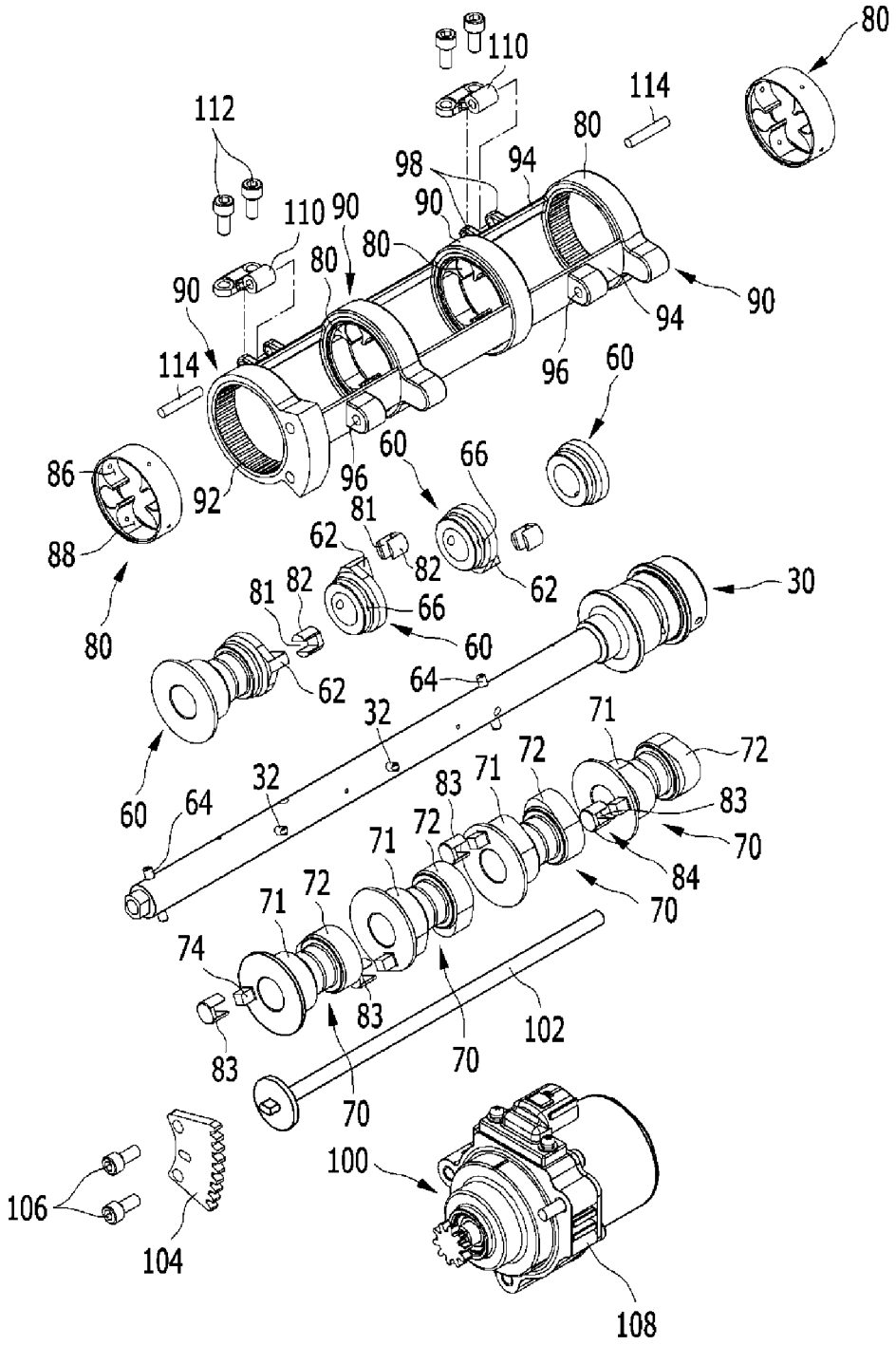
FIG. 2 is an exploded perspective view of a continuous variable valve duration apparatus according to an exemplary embodiment of the present invention.
Figure 3:
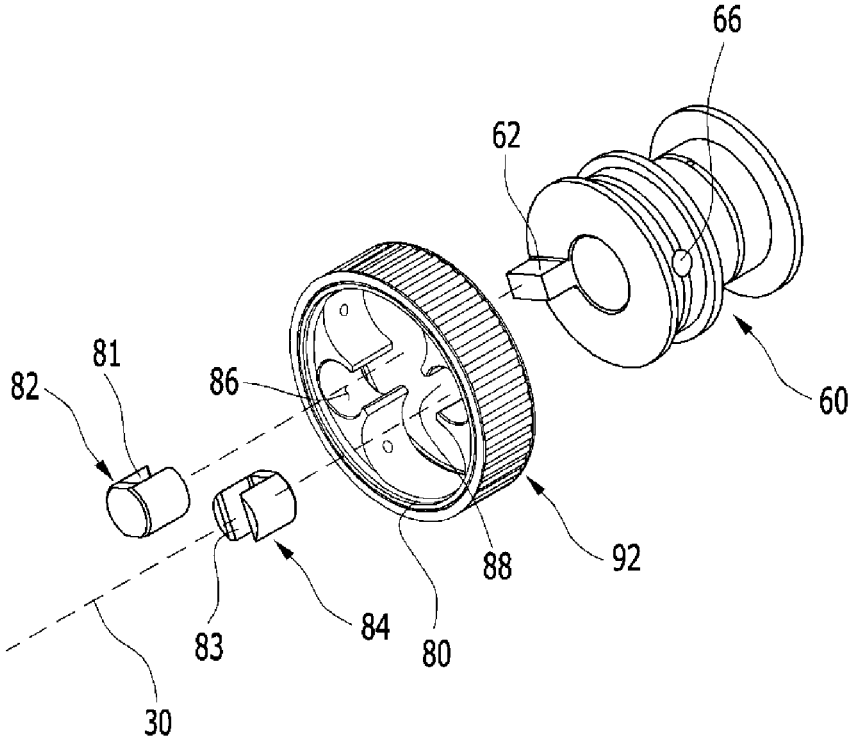
FIG. 3 is a partial exploded perspective view of a continuous variable valve duration apparatus according to an exemplary embodiment of the present invention.

FIG. 1 is a perspective view of an engine provided with a continuous variable valve duration apparatus according to an exemplary embodiment of the present invention, FIG. 2 is an exploded perspective view of a continuous variable valve duration apparatus according to an exemplary embodiment of the present invention, and FIG. 3 is a partial exploded perspective view of a continuous variable valve duration apparatus according to an exemplary embodiment of the present invention.

Referring to FIG. 1 to FIG. 3, an engine according to an exemplary embodiment of the present invention includes an engine block 1, and a cylinder head 10 disposed on the engine block 1 and a continuous variable valve duration apparatus mounted to the cylinder head 10.

The continuous variable valve duration apparatus includes a camshaft 30, a plurality of wheels 60 mounted to the camshaft 30, of which a wheel key 62 is formed thereto respectively, a plurality of cam portions 70 of which a cam 71 and/or 72 and a cam key 74 are formed thereto respectively, of which the camshaft 30 is inserted thereto, of which relative phase angle with respect to the camshaft 30 is variable, a plurality of inner brackets 80 connected with the each wheel key 62 and the each cam key 74, a plurality of a slider housings 90 of which the each inner bracket 80 is rotatably inserted thereto, and rotatably configured around a hinge bracket 110 connected to the cylinder head 10 and a control portion 100 selectively moving the slider housings 90 so as to change relative position of a rotation center of the inner brackets 80.

The camshaft 30 may be an intake camshaft or an exhaust camshaft.

In the drawing, the cam 71 and 72 is formed as a pair, but it is not limited thereto.

A cam cap engaging portion 76 may be formed to the cam portion 70 to be engaged a cam cap 40. While the cam cap engaging portion 76 is formed between the cams 71 and 72 in the drawings, but it is not limited thereto.

The cams 71 and/or 72 contacts to open valve 200.

The engine includes a plurality of cylinders 201, 202, 203 and 204, and the plurality of wheels 60 and the plurality of the cam portions are disposed corresponding to the each cylinder 201, 202, 203 and 204 respectively.

In the drawing, 4 cylinders are formed to the engine, but it is not limited thereto.

Engage holes 32 are formed to the camshaft 30 and a wheel hole 66 is formed to the each wheel 60. And a connecting pin 64 is inserted into the engage hole 32 and the wheel hole 66 respectively for connecting the wheels 60 and the camshaft 30.

The continuous variable valve duration apparatus further includes first pins 82 of which a wheel key slot 81, the each wheel key 62 is slidably inserted thereto, is formed thereto respectively and second pins 84 of which a cam key slot 83, the each the cam key 74 is slidably inserted thereto, is formed thereto respectively. And a first sliding pin hole 86 and a second sliding pin hole 88, of which the first pin 82 and the second pin 84 are inserted thereto respectively are formed to the inner bracket 80.

The first pin 82 and the second pin 84 are formed as a circular cylinder shape and the first sliding pin hole 86 and the second sliding pin hole 88 are formed for the first pin 82 and the second pin 84 to be rotated within thereto. Since the first pin 82, the second pin 84, the first sliding pin hole 86 and the second sliding pin hole 88 are formed as a circular cylinder, thus wear resistance may be enhanced.

Also, productivity may be increased due to simple shapes of the first pin 82, the second pin 84, the first sliding pin hole 86 and the second sliding pin hole 88.

The wheel key slot 81 of the first pin 82 and the cam key slot 83 of the second pin 84 are formed opposite direction.

Parts of the first sliding pin hole 86 and the second sliding pin hole 88 are opened for movements of the wheel key 62 and the cam key 74 not to be interrupted.

A bearing 92 is inserted between the slider housing 90 and the inner bracket 80. Thus, rotation of the inner bracket 80 may be easily performed.

In the drawings, the bearing 92 is depicted as a needle bearing, however it is not limited thereto. On the contrary, various bearings such as a ball bearing, a roller bearing and so on may be applied thereto.

The slider housings 90 are connected by a slider housing connecting plate 94. Thus, positions of the slider housings 90 are controlled through the slider housing connecting plate 94 and the slider housings 90 may be stably assembled.

Figure 4:
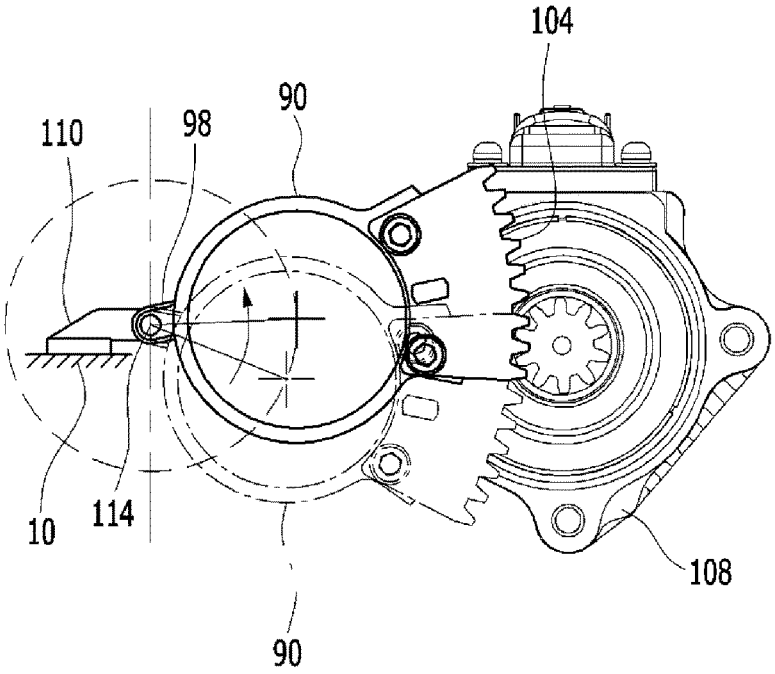
FIG. 4 and FIG. 5 are drawings showing operations of a continuous variable valve duration apparatus according to an exemplary embodiment of the present invention.
Figure 5:
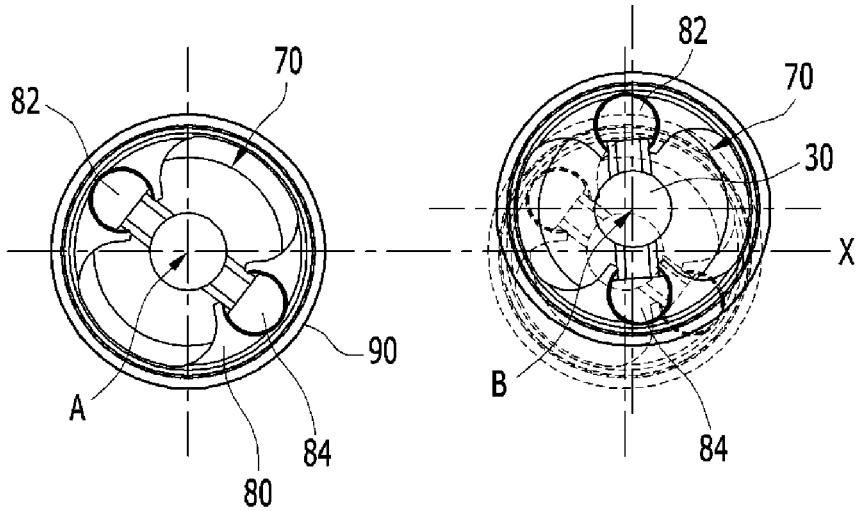

FIG. 4 and FIG. 5 are drawings showing operations of a continuous variable valve duration apparatus according to an exemplary embodiment of the present invention.

Referring to FIG. 1 to FIG. 5, the control portion 100 includes a control shaft 102, a shaft hole 96 is formed to the housing connecting plate 94 for the control shaft 102 to be inserted thereto, and a rotation center of the inner brackets 80 is changed with respect to a rotation center of the camshaft 30 according to a movement of the control shaft 102.

The control portion 100 further includes a control gear 104 connected with the control shaft 102 through connecting bolts 106 and a control motor 108 engaged with the control gear 104 and selectively rotating the control gear 104.

A hinge connecting portion 98 hingedly connected with the hinge bracket 110 is formed to the slider housing connecting plate 94, and the hinge bracket 110 and the hinge connecting portion 98 are rotatably connected through a hinge pin 114. The hinge bracket 110 is connected to the cylinder head 10 through hinge bracket connecting bolts 112.

Referring to FIG. 1 to FIG. 6, operations of the continuous variable valve duration apparatus according to various aspects of the present invention will be discussed.

As shown in a left side of FIG. 5, since a rotation center of the inner bracket 80 coincides with a rotation center of the cam shaft 30, relative rotation speed changes between the cam 71 and 72 and the camshaft 30 are not occurred. That is, the cam 71 and 72 and the cam shaft 30 rotate with same speed and same phase.

According to engine operation states, an ECU (engine control unit or electric control unit) transmits control signals to the motor 108 of the control portion 100 to change a relative position of the slider housing 90.

For example, as shown in FIG. 4 and FIG. 5 when the motor 108 rotates the control gear 104 for the slider housing 90 to be moved, the rotation center of the inner bracket 80 moves with respect to the rotation center of the camshaft 30. Thus, angular acceleration of the cam portion 70 so as that duration of the valves 200.

As shown in the left side of FIG. 5, the rotation center of the inner bracket 80 coincides with the rotation center of the cam shaft 30, and "A" indicates the rotation centers of the inner bracket 80 and the cam shaft 30.

In this state, if the motor 108 rotates the control gear 104, relative positions of the slider housing 90 and the inner bracket 80 are changed. Thus, as shown a right side of FIG. 5, a rotation center of the inner bracket 80 is changed to B, then the rotation center of the inner bracket 80 with respect to that of the camshaft 30 is changed.

Figure 6:
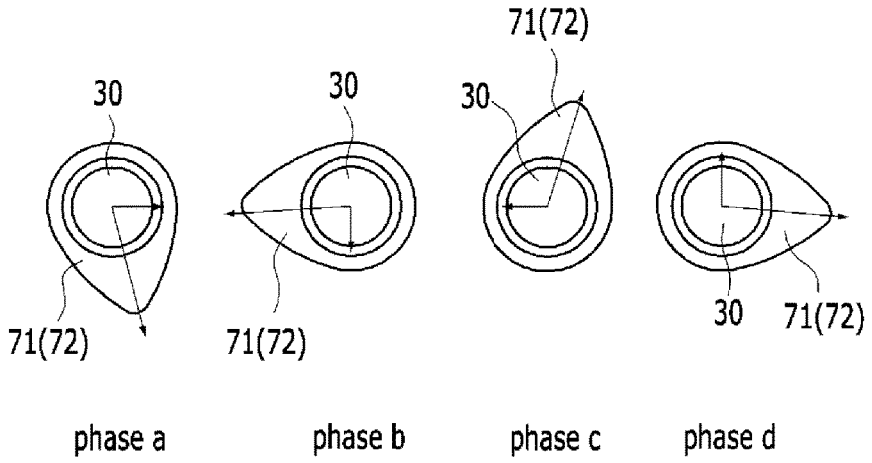
FIG. 6 and FIG. 7 are drawings showing mechanical motions of cams of a continuous variable valve duration apparatus according to an exemplary embodiment of the present invention.
Figure 7:
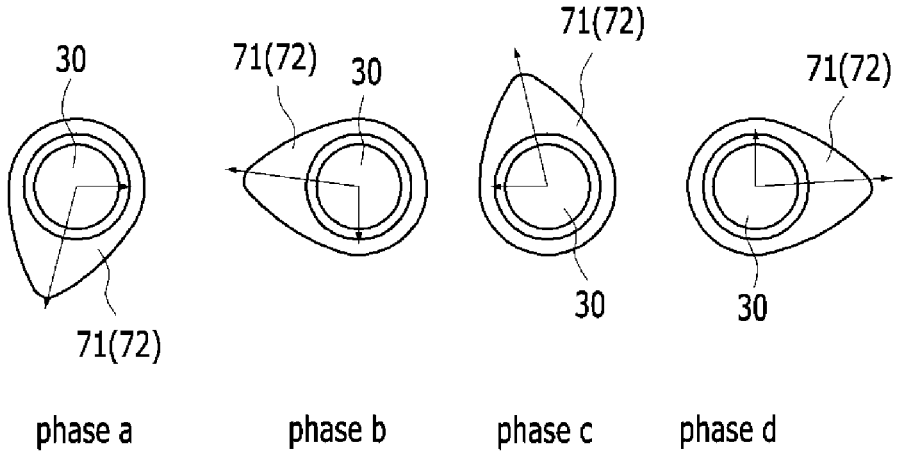

FIG. 6 and FIG. 7 are drawings showing mechanical motions of cams of a continuous variable valve duration apparatus according to an exemplary embodiment of the present invention.

As shown in FIG. 6, while the phase angle of the camshaft 30 is constantly changed when the relative rotation center of the cams 71 and 72 with respect to the rotation center of the camshaft 30 is changed downward, the rotation speed of the cams 71 and 72 is relatively faster than rotation speed of the camshaft 30 from phase a to phase b and from phase b to phase c, then the rotation speed of the cams 71 and 82 is relatively slower than rotation speed of the camshaft 30 from phase c to phase d and from phase d to phase a. That is, the valve duration is changed.

As shown in FIG. 7, while the phase angle of the camshaft 30 is constantly changed when the relative rotation center of the cams 71 and 72 with respect to the rotation center of the camshaft 30 is changed upward, the rotation speed of the cams 71 and 72 is relatively slower than rotation speed of the camshaft 30 from phase a to phase b and from phase b to phase c, then the rotation speed of the cams 71 and 82 is relatively faster than rotation speed of the camshaft 30 from phase c to phase d and from phase d to phase a. That is, the valve duration is changed.

While the wheel 60 is rotated together with the camshaft 30, the wheel key 62 is slidable within the wheel key slot 81, the first pin 82 and the second pin 84 are rotatable within the first sliding pin hole 86 and the second sliding pin hole 88 respectively and the cam key 74 is slidable within the cam key slot 83. Thus, when the relative rotation centers of the inner bracket 80 and the camshaft 30 are changed, the relative rotation speed of the cams 71 and 72 with respect to the rotation speed of the camshaft 30 is changed.

Figure 8:
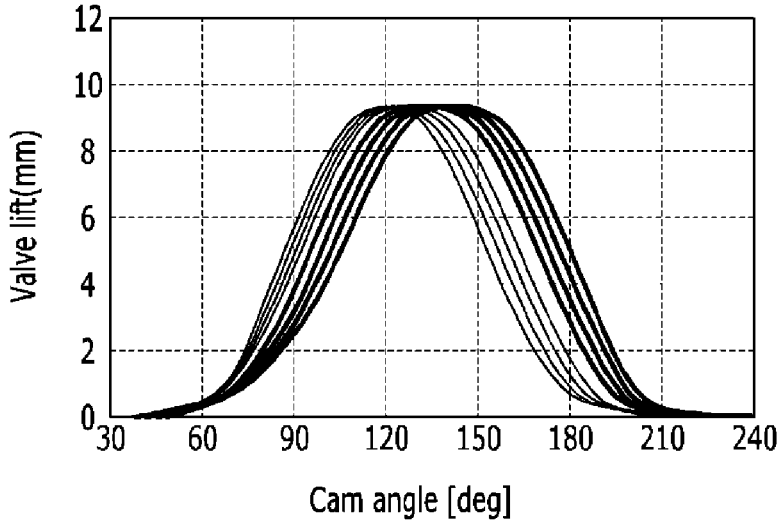
FIG. 8 is a graph of a valve profile of a continuous variable valve duration apparatus according to an exemplary embodiment of the present invention.

FIG. 8 is a graph of a valve profile of a continuous variable valve duration apparatus according to an exemplary embodiment of the present invention.

As shown in FIG. 8, although maximum lift of the valve 200 is constant, however rotation speed of the cam 71 and 72 with respect to the rotation speed of the camshaft 30 is changed according to relative positions of the slider housing 90 so that duration of the valve 200 is changed and various valve profile may be performed.

As an example shown in FIG. 8, opening time of the valve 200 is constant and closing time of the valve 200 is controlled, however, it is not limited thereto. According to mounting angle of the valve 200 and so on, various valve durations may be performed.

Determinations of the control signals of the ECU according to the engine operation state is obvious to a person skilled in the art, thus detailed description will be omitted.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration apparatus comprising:

a camshaft;

a plurality of wheels mounted to the camshaft, of which a wheel key is formed thereto respectively;

a plurality of cam portions of which a cam and a cam key are formed thereto respectively, of which the camshaft is inserted thereto, of which relative phase angle with respect to the camshaft is variable;

a plurality of inner brackets connected with each wheel key and each cam key;

a plurality of slider housings of which each inner bracket is rotatably inserted thereto, and rotatably configured around a hinge bracket connected to a cylinder head; and a control portion selectively moving the slider housings to change relative position of a rotation center of the inner brackets.

2. The continuous variable valve duration apparatus of claim 1, further comprising:

first pins of which a wheel key slot, the each wheel key is slidably inserted thereto, is formed thereto respectively; and second pins of which a cam key slot, the each cam key is slidably inserted thereto, is formed thereto respectively, and wherein a first sliding pin hole and a second sliding pin hole, of which the first pins and the second pins are inserted thereto respectively, are formed to the inner bracket.

3. The continuous variable valve duration apparatus of claim 2, wherein the first pins and the second pins are formed as a circular cylinder shape; and the first sliding pin hole and the second sliding pin hole are formed for the first pins and the second pins to be rotated within thereto.

4. The continuous variable valve duration apparatus of claim 3, wherein the wheel key slot of the first pins and the cam key slot of the second pins are formed opposite direction.

5. The continuous variable valve duration apparatus of claim 4, wherein parts of the first sliding pin hole and the second sliding pin hole are opened for movements of the wheel key and the cam key not to be interrupted.

6. The continuous variable valve duration apparatus of claim 1, further comprising:

a bearing inserted between the slider housing and the inner bracket.

7. The continuous variable valve duration apparatus of claim 1, wherein the slider housings are connected by a slider housing connecting plate.

8. The continuous variable valve duration apparatus of claim 7, wherein the control portion comprises a control shaft, and wherein a shaft hole is formed to the housing connecting plate for the control shaft to be inserted thereto, and a rotation center of the inner brackets is changed with respect to a rotation center of the camshaft according to a movement of the control shaft.

9. The continuous variable valve duration apparatus of claim 8, wherein the control portion further comprises:

a control gear connected with the control shaft; and a control motor engaged with the control gear and selectively rotating the control gear.

10. The continuous variable valve duration apparatus of claim 8, wherein a hinge connecting portion hingedly connected with the hinge bracket is formed to the slider housing connecting plate.

11. The continuous variable valve duration apparatus of claim 1, wherein the wheel is connected with the camshaft through a connecting pin.

12. An engine comprising:

a camshaft;

a plurality of wheels mounted to the camshaft, of which a wheel key is formed thereto respectively, and disposed corresponding to each cylinder;

a plurality of cam portions of which a cam and a cam key are formed thereto respectively, of which the camshaft is inserted thereto, of which relative phase angle with respect to the camshaft is variable and disposed corresponding to the each cylinder;

a plurality of inner brackets of which a first sliding pin hole and a second sliding pin hole, connected with each wheel key and each cam key are formed respectively thereto;

a plurality of slider housings of which each inner bracket is rotatably inserted thereto, and rotatably configured around a hinge bracket connected to a cylinder head;

first pins of which a wheel key slot, the each wheel key is slidably inserted thereto, is formed thereto respectively and rotatably inserted into the first sliding pin hole;

second pins of which a cam key slot, the each the cam key is slidably inserted thereto, is formed thereto opposite to the wheel key slot respectively, and rotatably inserted into the second sliding pin hole; and a control portion selectively moving the slider housings to change relative position of a rotation center of the inner brackets.

13. The engine of claim 12, wherein parts of the first sliding pin hole and the second sliding pin hole are opened for movements of the wheel key and the cam key not to be interrupted.

14. The engine of claim 12, further comprising:

a bearing inserted between the slider housing and the inner bracket.

15. The engine of claim 12, wherein the slider housings are connected by a slider housing connecting plate.

16. The engine of claim 15, wherein the control portion comprises a control shaft, and wherein a shaft hole is formed to the housing connecting plate for the control shaft to be inserted thereto, and a rotation center of the inner brackets is changed with respect to a rotation center of the camshaft according to a movement of the control shaft.

17. The engine of claim 16, wherein the control portion further comprises:

a control gear connected with the control shaft; and a control motor engaged with the control gear and selectively rotating the control gear.

18. The engine of claim 16, wherein a hinge connecting portion hingedly connected with the hinge bracket is formed to the slider housing connecting plate.

19. The engine of claim 12, wherein the wheels are connected with the camshaft through a connecting pin.

* * * * *